US007889143B2

(12) United States Patent
Milosavljevic et al.

(10) Patent No.: US 7,889,143 B2
(45) Date of Patent: Feb. 15, 2011

(54) MULTIBAND ANTENNA SYSTEM AND METHODS

(75) Inventors: Zlatoljub Milosavljevic, Kempele (FI); Pertti Nissinen, Kempele (FI); Antti Leskelä, Oulu (FI); Petteri Annamaa, Oulunsalo (FI)

(73) Assignee: Pulse Finland Oy (FI)

( * ) Notice: Subject to any disclaimer, the term of this patent is extended or adjusted under 35 U.S.C. 154(b) by 394 days.

(21) Appl. No.: 12/080,741

(22) Filed: Apr. 3, 2008

(65) Prior Publication Data

US 2010/0149057 A9 Jun. 17, 2010

Related U.S. Application Data

(63) Continuation of application No. PCT/FI2006/050402, filed on Sep. 20, 2006.

(51) Int. Cl.
*H01Q 1/00* (2006.01)
*H01Q 9/00* (2006.01)

(52) U.S. Cl. ..... 343/722; 343/749

(58) Field of Classification Search ..... 343/702, 343/722, 745, 749, 750, 751, 876; 455/552.1, 455/550.1, 575.7

See application file for complete search history.

(56) References Cited

U.S. PATENT DOCUMENTS

| | | | |
|---|---|---|---|
| 4,069,483 | A | 1/1978 | Kaloi |
| 5,298,873 | A | 3/1994 | Ala-Kojola |
| 5,349,700 | A | 9/1994 | Parker |
| 5,387,886 | A | 2/1995 | Takalo |
| 5,905,475 | A | 5/1999 | Annamaa |
| 6,140,973 | A | 10/2000 | Annamaa |

(Continued)

FOREIGN PATENT DOCUMENTS

| | | |
|---|---|---|
| EP | 0 332 139 | 9/1989 |

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

(Continued)

*Primary Examiner*—Hoang V Nguyen
(74) *Attorney, Agent, or Firm*—Gazdzinski & Associates, PC

(57) ABSTRACT

An antenna system internal to a radio device, the system comprising separate antennas and having separate operating bands. The system is implemented as decentralized in a way that each antenna is typically based on a small-sized chip component, which are located at suitable places on the circuit board and possibly on also another internal surface in the device. The chip component comprises a ceramic substrate and at least one radiating element. The operating band of an individual antenna covers, for example, the frequency range used by a radio system or only the transmitting or receiving band in that range. At least one antenna is connected to an adjusting circuit with a switch, by which the antenna's operating band can be displaced in a desired way. In this case the operating band covers at a time a part of the frequency range used by one or two radio systems.

34 Claims, 7 Drawing Sheets

U.S. PATENT DOCUMENTS

| | | | | |
|---|---|---|---|---|
| 6,185,434 | B1 | 2/2001 | Hagstrom | |
| 6,252,554 | B1 | 6/2001 | Isohatala | |
| 6,323,811 | B1 | 11/2001 | Tsubaki | |
| 6,456,249 | B1 | 9/2002 | Johnson et al. | |
| 6,473,056 | B2 | 10/2002 | Annamaa | |
| 6,650,295 | B2 | 11/2003 | Ollikainen et al. | |
| 6,683,573 | B2 | 1/2004 | Park | |
| 6,781,545 | B2 | 8/2004 | Sung | |
| 6,862,441 | B2 | 3/2005 | Ella | |
| 7,081,857 | B2 | 7/2006 | Kinnunen | |
| 7,099,690 | B2 * | 8/2006 | Milosavljevic | 455/552.1 |
| 7,136,019 | B2 | 11/2006 | Mikkola | |
| 7,142,824 | B2 | 11/2006 | Kojima et al. | |
| 7,148,849 | B2 | 12/2006 | Lin | |
| 7,176,838 | B1 | 2/2007 | Kinezos | |
| 7,205,942 | B2 | 4/2007 | Wang et al. | |
| 7,218,282 | B2 | 5/2007 | Humpfer et al. | |
| 7,224,313 | B2 | 5/2007 | McKinzie, III et al. | |
| 7,274,334 | B2 | 9/2007 | O'Riordan et al. | |
| 7,289,064 | B2 | 10/2007 | Cheng | |
| 7,292,200 | B2 | 11/2007 | Posluszny et al. | |
| 7,330,153 | B2 | 2/2008 | Rentz | |
| 7,339,528 | B2 | 3/2008 | Wang et al. | |
| 7,340,286 | B2 | 3/2008 | Korva | |
| 7,345,634 | B2 | 3/2008 | Ozkar et al. | |
| 7,352,326 | B2 | 4/2008 | Korva | |
| 2002/0019247 | A1 | 2/2002 | Egorov | |
| 2002/0145569 | A1 | 10/2002 | Onaka | |
| 2002/0163470 | A1 | 11/2002 | Nagumo et al. | |
| 2002/0183013 | A1 | 12/2002 | Auckland et al. | |
| 2002/0196192 | A1 | 12/2002 | Nagumo et al. | |
| 2003/0020659 | A1 | 1/2003 | Kushihi | |
| 2004/0066336 | A1 | 4/2004 | De Graauw | |
| 2004/0080457 | A1 | 4/2004 | Guo et al. | |
| 2004/0090378 | A1 | 5/2004 | Dai et al. | |
| 2004/0178957 | A1 | 9/2004 | Chang et al. | |
| 2005/0024268 | A1 | 2/2005 | McKinzie, III et al. | |
| 2005/0024272 | A1 | 2/2005 | Ponce De Leon et al. | |
| 2005/0057401 | A1 | 3/2005 | Yuanzhu | |
| 2005/0057416 | A1 | 3/2005 | Yuanzhu | |
| 2005/0176481 | A1 | 8/2005 | Jeong | |
| 2006/0145924 | A1 | 7/2006 | Chen et al. | |
| 2007/0013589 | A1 | 1/2007 | Park et al. | |
| 2007/0109202 | A1 | 5/2007 | Vance | |
| 2007/0115177 | A1 | 5/2007 | Kaunari | |
| 2007/0139277 | A1 | 6/2007 | Nissinen | |
| 2007/0152885 | A1 | 7/2007 | Sorvala | |
| 2007/0159399 | A1 | 7/2007 | Perunka | |
| 2007/0171131 | A1 | 7/2007 | Sorvala | |
| 2007/0241970 | A1 | 10/2007 | Thornell-Pers | |
| 2007/0268190 | A1 | 11/2007 | Huynh | |
| 2007/0273606 | A1 | 11/2007 | Mark et al. | |
| 2007/0290938 | A1 | 12/2007 | Loyet | |
| 2008/0088511 | A1 | 4/2008 | Sorvala | |
| 2008/0204328 | A1 | 8/2008 | Nissinen | |
| 2008/0266199 | A1 | 10/2008 | Milosavljevic | |
| 2008/0284661 | A1 | 11/2008 | He | |
| 2008/0316116 | A1 | 12/2008 | Hobson et al. | |
| 2009/0135066 | A1 | 5/2009 | Raappana | |

FOREIGN PATENT DOCUMENTS

| | | |
|---|---|---|
| EP | 0 766 340 | 4/1997 |
| EP | 0 831 547 | 3/1998 |
| EP | 1 294 048 | 1/1999 |
| EP | 1 139 490 | 10/2001 |
| EP | 1 162 688 | 12/2001 |
| EP | 1 361 623 | 11/2003 |
| EP | 1 469 549 | 10/2004 |
| EP | 1 498 984 | 1/2005 |
| EP | 1 544 943 | 6/2005 |
| EP | 1 791 213 | 5/2007 |
| JP | 03 280625 | 12/1991 |
| JP | 10 028013 | 1/1998 |
| JP | 10 209733 | 8/1998 |
| JP | 11 004117 | 1/1999 |
| JP | 11 068456 | 3/1999 |
| JP | 11 355033 | 12/1999 |
| JP | 2001217631 | 10/2001 |
| JP | 2002319811 | 10/2002 |
| JP | 2004112028 | 4/2004 |
| JP | 2004363859 | 12/2004 |
| JP | 2005252661 | 9/2005 |
| WO | WO 98/01921 | 1/1998 |
| WO | WO 98/37592 | 8/1998 |
| WO | WO 00/36700 | 6/2000 |
| WO | WO 01/28035 | 4/2001 |
| WO | WO 01/33665 | 5/2001 |
| WO | WO 02/11236 | 2/2002 |
| WO | WO 02/078123 | 10/2002 |
| WO | WO 2004/017462 | 2/2004 |
| WO | WO 2004/036778 | 4/2004 |
| WO | WO 2004/057697 | 7/2004 |
| WO | WO 2004/112189 | 12/2004 |
| WO | WO 2005/038981 | 4/2005 |
| WO | WO 2007/000483 | 1/2007 |
| WO | WO 2007/012697 | 2/2007 |
| WO | WO 2007/039667 | 4/2007 |
| WO | WO 2007/039668 | 4/2007 |
| WO | WO 2007/042615 | 4/2007 |
| WO | WO 2007/138157 | 12/2007 |

OTHER PUBLICATIONS

Product of the Month, RFDesign, "GSM/GPRS Quad Band Power Amp Includes Antenna Switch," 1 page, reprinted Nov. 2004 issue of RF Design (www.rfdesign.com) Copyright 2004, Freescale Semiconductor, RFD-24-EK.

Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 5.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

O. Kivekäs, et al.; "Frequency-tunable internal antenna for mobile phones", Proceedings of 12èmes Journées Internationales de Nice sur les Antennes, 12th Int'l Symposium on Antennas (JINA 2002), vol. 2, 2002, Nice, France, s.53-56, tiivistelmä.

* cited by examiner

MULTIBAND ANTENNA SYSTEM AND METHODS

PRIORITY AND RELATED APPLICATIONS

This application is a continuation of prior International PCT Application No. PCT/FI2006/050402 having an international filing date of Sep. 20, 2006, which claims priority to Finland Patent Application No. 20055527 filed Oct. 3, 2005, as well as Finland Patent Application No. 20055554 filed Oct. 14, 2005, each of the foregoing incorporated herein by reference in its entirety. This application is related to co-owned and co-pending U.S. patent application Ser. No. 12/083,129 filed contemporaneously herewith and entitled "Multiband Antenna System And Methods", Ser. No. 12/009,009 filed Jan. 15, 2008 and entitled "Dual Antenna Apparatus And Methods", Ser. No. 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. No. 11/648,429 filed Dec. 28, 2006 and entitled "Antenna, Component And Methods", and Ser. No. 11/648,431 also filed Dec. 28, 2006 and entitled "Chip Antenna Apparatus and Methods", both of which are incorporated herein by reference in their entirety. This application is further related to U.S. patent application Ser. No. 11/901,611 filed Sep. 17, 2007 entitled "Antenna Component and Methods", Ser. No. 11/883,945 filed Aug. 6, 2007 entitled "Internal Monopole Antenna", Ser. No. 11/801,894 filed May 10, 2007 entitled "Antenna Component", and Ser. No. 11/922,976 entitled "Internal multiband antenna and methods" filed Dec. 28, 2007, each of the foregoing incorporated by reference herein in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to an internal antenna system of a radio device with separate operating bands. The system is intended for use especially in small-sized mobile stations.

In small-sized, mobile radio devices the antenna is preferably placed inside the casing of the device for convenience. This makes the design of the antenna a more demanding task compared to an external antenna. Extra difficulties in the design is caused when the radio device has to function in a plurality of frequency ranges, the more the wider these ranges or one of them are.

Internal antennas most often have a planar structure, in which case they have a radiating plane and a parallel ground plane at a certain distance from it. The radiating plane is provided with a short-circuit and feed point of the antenna. The short-circuit conductor belonging to the structure extends from the short-circuit point to the ground plane, and the feed conductor of the antenna extends from the feed point to the antenna port of the device. For increasing the number of operating bands of the antenna, the radiating plane can be divided into two or more branches of different length as seen from the short-circuit point. The number of bands can also be increased by a parasitic auxiliary element. As an alternative, a parasitic element can be used for widening an operating band by arranging the resonance frequency corresponding to it relatively close to the resonance frequency corresponding to a branch of the radiating plane.

In this description and the claims, the terms "radiating plane", "radiating element" and "radiator" mean an antenna element, which can function as a part transmitting radiofrequency electromagnetic waves, as a part receiving them or as a part which both transmits and receives them. Correspondingly, "feed conductor" means a conductor which can also function as a receiving conductor.

The antennas of the kind described above have the drawback that their characteristics are insufficient when the number of radio systems in accordance with which the radio device must function increases. The insufficiency appears e.g. from that the matching of the antenna is poor in the band used by one of the radio systems or in a part of at least one of such bands. In addition, it is difficult to make sufficient isolation between the antenna parts corresponding to different bands. The drawbacks are emphasized when the antenna size has to be compromised because of the lack of space. The size is reduced by shortening the distance between the radiating plane and the ground plane or by using dielectric material between them, for example.

It is also possible to arrange two radiators in the antenna structure so that they both have a feed conductor of their own. This comes into question when the radio device has a separate transmitter and receiver for some radio system. FIG. 1 shows an example of such an antenna structure known from the publication WO 02/078123. It comprises a ground plane 101, a radiating plane 110, a parasitic element 113 of the radiating plane and a segregated radiator 107. The radiating plane has a feed conductor 102 and a short-circuit conductor, and it thus forms a PIFA (Planar Inverted F-Antenna) together with the ground plane. The PIFA has two bands, because the radiating plane is divided into a first 111 and a second 112 branch as seen from the short-circuit and feed point. The first branch functions as a radiator in the frequency range of the GSM900 (Global System for Mobile communications) and the second branch in the range of the DCS (Digital Cellular Standard) system. The parasitic element 113 is connected to the ground plane and it functions as a radiator in the range of the PCS (Personal Communication Service) system. The segregated radiator 107 has its own feed conductor 103 and short-circuit conductor. Together with the ground plane it forms an IFA, which functions as a Bluetooth antenna. The segregated radiator is located near the radiating plane and its parasitic element so that the short-circuit and feed conductors of the radiating plane, the short-circuit conductor of the parasitic element and the short-circuit and feed conductors of the segregated radiator are in a row in a relatively small area compared to the dimensions of the antenna structure. The support structure of the antenna elements is not visible in the drawing.

The segregated radiator mentioned above, provided with its own feed, is thus for the Bluetooth system. Such a radiator can similarly be e.g. for the WCDMA (Wideband Code Division Multiple Access) system. In general, the use of a segregated radiator provided with its own feed reduces the drawbacks mentioned above to such an extent that the matching can be made good at least in the frequency range of the radio system for which the segregated radiator is provided.

The use of dielectric material for reducing the physical size of the antenna was mentioned above. FIG. 2 shows an example of such a known antenna. This comprises a dielectric substrate 211, a radiator 212 and its feed element 213. The radiator and the feed element are conductor strips on the surface of the substrate. All three together form an antenna component, which is mounted on the circuit board PCB of a radio device.

SUMMARY OF THE INVENTION

In a first aspect of the invention, an antenna system of a multiband radio device is disclosed. In one embodiment, the antenna system is implemented in an internal and decentralized way such that the device has a plurality of separate antennas. Each antenna is typically based on a small-sized chip component with a ceramic substrate and at least one radiating element. The chip components are located at suitable places on the circuit board and possibly on also another internal surface of the device. The operating band of an individual antenna covers the frequency range used by one radio system or only the transmitting or receiving band of that range. At least one antenna is connected to an adjusting circuit provided with a switch, by means of which circuit the antenna operating band can be displaced in a desired way. In this case the operating band covers at a time a part of the frequency range used by one or two radio systems.

The exemplary embodiment of the invention has the advantage that the size of the antennas can be made small. This is due to that when there is a plurality of antennas, a relatively small bandwidth is sufficient for an individual antenna. When the bandwidth is small, a material with higher permittivity can be chosen for the antenna than for an antenna having a wider band, in which case the antenna dimensions can be made correspondingly smaller. In addition, the invention has the advantage that a good matching is achieved on the whole width of the band of each radio system. This is due to that the matching of a separate antenna having a relatively narrow band is easier to arrange than the matching of a combined multiband antenna. The exemplary embodiment of the invention further has the advantage that the number of the necessary antennas can be decreased without compromising the matching. For example, when the time division duplex is used, the separate transmitting and receiving antennas can be replaced with an antenna equipped with said adjusting circuit. The operating band of this antenna is displaced from the transmitting band to the receiving band and vice versa, as needed. The matching and also the efficiency are in part improved by the fact that in a decentralized system the antennas can each be located in a place which is advantageous with regard to its function. The exemplary embodiment of the invention further has the advantage that the isolation between the antennas is good. This is due to the sensible decentralization of the antennas and the fact that a substrate with a relatively high permittivity collapses the near field of the antenna.

In a second aspect of the invention, an adjusting circuit for use with an antenna system of a radio device is disclosed. In one embodiment, the adjusting circuit comprises: an input electrically coupled to an antenna component; a filter circuit; a switching circuit; and a plurality of reactive circuits each coupled to an end of the switching circuit.

In one variant, the plurality of reactive circuits each comprise a different operating band.

In another variant, the number of the plurality of reactive circuits is three.

In a further variant, each of the plurality of reactive circuits is further coupled to ground.

In yet another variant, the filter circuit is adapted to attenuate at least a portion of harmonic frequency components that develop within the switching circuit. The filter circuit may further comprise for example electrostatic discharge (ESD) protection.

In still another variant, the positioning of the switching circuit is controlled by a control signal.

In another variant, at least one of the plurality of reactive circuits comprises an inductive reactance. Alternatively, at least one of the plurality of reactive circuits may comprise a capacitive reactance.

In yet a further variant, each of the plurality of reactive circuits comprises a transmission line coupled to ground. Each of the transmission lines for the plurality of reactive circuits may be of a differing length.

In another variant, each of the plurality of reactive circuits is adapted for a plurality of separate operating applications. For example, the plurality of separate operating applications are selected from the group consisting of: a GSM850 application; a GSM900 application; a GSM1800 application; a GSM1900 application; and a WCDMA application.

In a third aspect of the invention, a method of operating an antenna system of a radio device is disclosed. In one embodiment, the antenna system comprises a ground plane, an antenna and an adjusting circuit, and the method comprises: operating the antenna system in a first mode of operation; sending a control signal to the adjusting circuit, the control signal switching an operating mode of the adjusting circuit; and operating the antenna system in a second mode of operation, the first and second modes of operation utilizing the same antenna.

In one variant, the first and second modes of operation comprise the GSM850 and GSM900 modes of operation, respectively.

In another variant, the first and second modes of operation comprise the GSM1800 and GSM1900 modes of operation, respectively.

In yet another variant, the method further comprises operating the antenna system in a third mode of operation, the third mode of operation using the same antenna as the first and second modes of operation.

In a further variant, the first, second and third modes of operation comprise the GSM850 receiving band, GSM900 transmitting band and GSM900 receiving bands, respectively.

In a fourth aspect of the invention, an antenna system of a radio device is disclosed. In one embodiment, the system comprises: a ground plane; at least two antennas each comprising a radiating element, wherein each radiating element comprises a conductor on a surface of a dielectric substrate; wherein a distance along the ground plane between two of the radiating elements belonging to different antennas is at least the combined length of these two radiating elements; and wherein at least one antenna is connected to an adjusting circuit.

In one variant, the adjusting circuit comprises: a switching circuit; and a plurality of reactive circuits each coupled to an end of the switching circuit.

In another variant, at least one of the antennas is disposed on a surface of an internal frame of the radio device.

In another embodiment, the system comprises a ground plane and at least two antennas, each radiating element of which is a conductor on a surface of a dielectric substrate, and the system is characterized in that: a distance along the ground plane between two radiating elements belonging to different ones of the antennas is at least the combined length of these radiators, and at least one of the antennas is connected to an adjusting circuit adapted to displace an operating band thereof.

In one variant, the substrate of an individual one of the at least two antennas and the at least one radiating element on the surface of the substrate constitute a unitary, chip-type antenna component, and the antenna component is located on a circuit board of the radio device.

In another variant, the antenna component is disposed on a surface of an internal frame of the radio device.

In yet another variant, an operating band of at least one of the at least two antennas comprises a frequency range used by at least one radio system.

In a further variant, an operating band of at least one of the at least two antennas comprises a transmitting band in the frequency range used by a radio system, and an operating band of another one of the at least two antennas comprises a receiving band of the same frequency range.

In still another variant, at least one of the at least two antennas comprises an operating band of which includes the receiving band of the frequency range used to implement a spatial diversity function.

In yet another variant, the adjusting circuit comprises a switch and alternative reactive circuits adapted to change a resonance frequency of at least one of the antennas so as to displace an operating band of the at least one antenna. The reactive circuits comprise for example planar transmission lines. The adjusting circuit may be connected galvanically to a radiating element of one of the antennas.

In a further variant, the substrate of an individual one of the at least two antennas comprises a part of an outer casing of the radio device.

DETAILED DESCRIPTION OF THE INVENTION

Reference is now made to the drawings wherein like numerals refer to like parts throughout.

Figure 1:
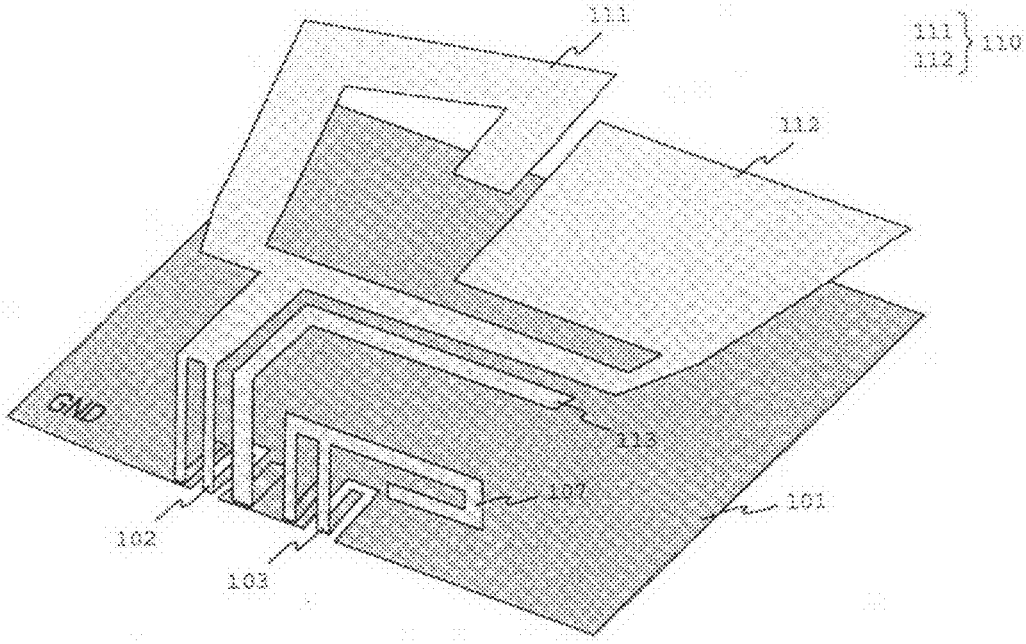
Fig. 1 PRIOR ART
FIG. 1 shows an example of a known multiband antenna.
Figure 2:
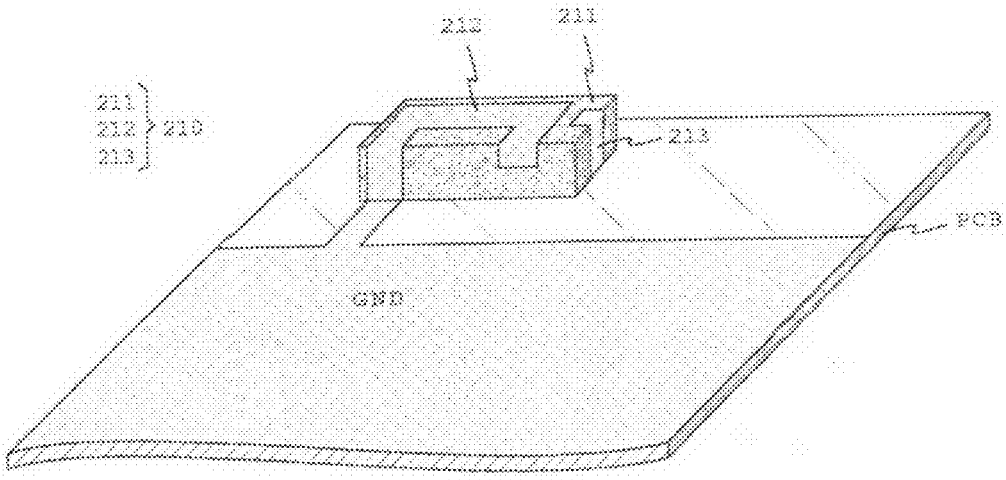
Fig. 2 PRIOR ART
FIG. 2 shows an example of a known antenna component using a dielectric substrate.

FIGS. 1 and 2 were already described in connection with the prior art.

Figure 3:
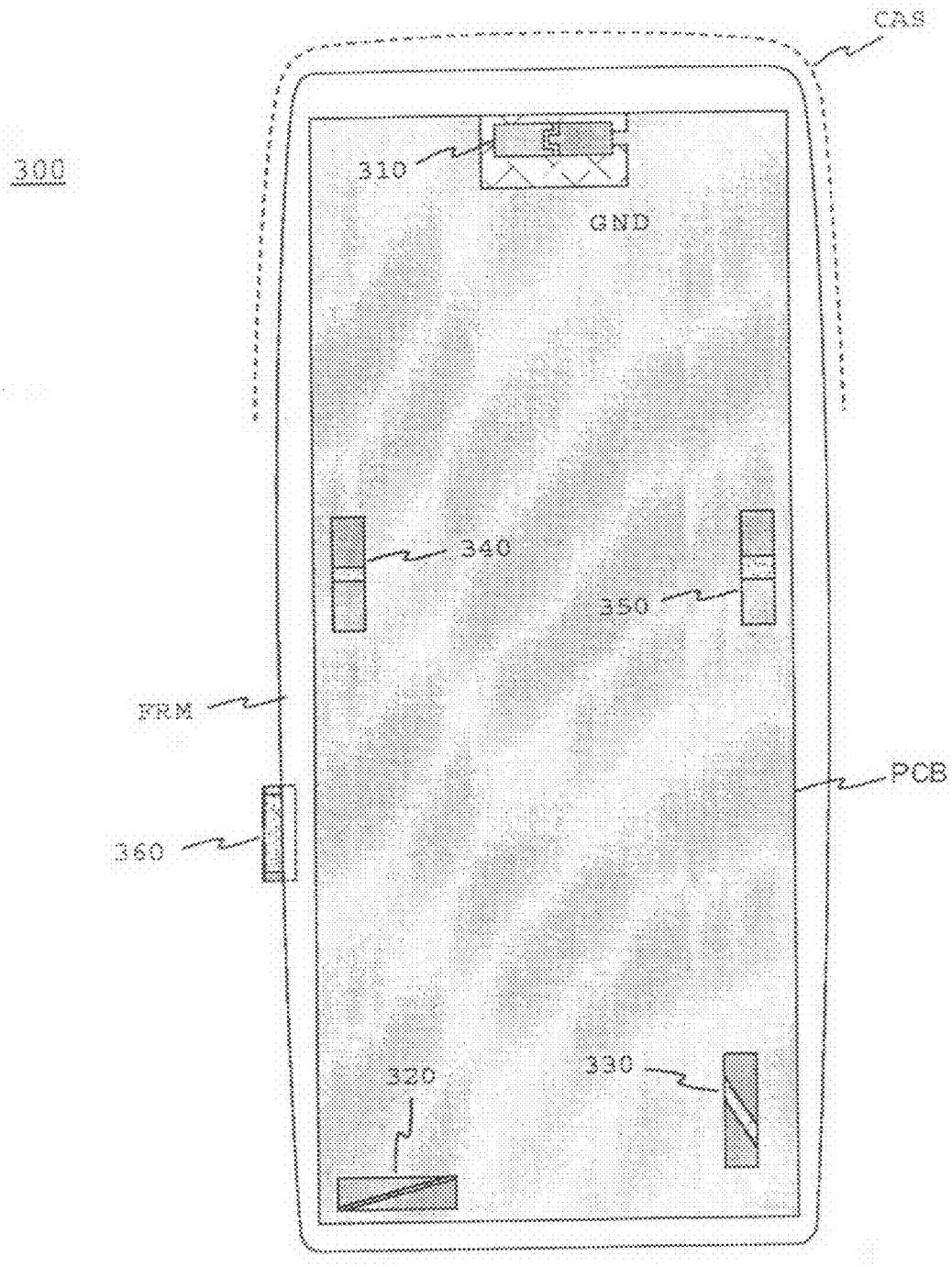
FIG. 3 shows an example of the placement of the antennas in an antenna system according to the invention.

FIG. 3 shows an example of an antenna system according to the invention as a layout drawing. There is a radio device 300 with a circuit board PCB, plastic frame FRM and casing CAS in the drawing. A large part of the surface of the circuit board on the side visible in the drawing consists of a conductive ground plane GND. In this example the antenna system includes six antennas. Each one of these comprises an elongated antenna component with a ceramic substrate and two radiating elements. The ground plane around the antenna component is also considered to be a part of the antenna here. In this example, the radiating elements of each antenna component are of the same size so that they resonate on the same, relatively narrow frequency range. The feed conductor of an antenna is connected to one element, and the other element is parasitic.

The first 310, the second 320, the third 330, the fourth 340 and the fifth 350 antenna component are mounted on the same side of the circuit board PCB, visible in the drawing. The first antenna component 310 is located in the middle of the first end of the circuit board, parallel with the end. The second antenna component 320 is located in a corner defined by the second end and the first long side of the circuit board, parallel with the end. The third antenna component 330 is located near the corner defined by the second end and the second long side of the circuit board, parallel with the long side. The fourth antenna component 340 is located beside the first long side of the circuit board parallel with it, slightly closer to the first than the second end. The fifth antenna component 350 is located beside the second long side of the circuit board parallel with it, opposite to the fourth antenna component. The sixth antenna component 360 is mounted on the side surface of the frame FRM, which surface is perpendicular to the plane of the circuit board. The antenna components are located at places which are advantageous with regard to the other RF parts and so that they do not much interfere with each other.

FIG. 3 also shows an example of the ground arrangement of the antennas. The ground plane of the surface of the circuit board has been removed from below and beside the first antenna component 310 to a certain distance. However, a narrow part of the ground plane extends to one or more points of the radiators. In practice, the system has mainly antenna-dedicated ground planes because of the decentralization of the antenna components. This becomes evident from the fact that the distance along the ground plane between two radiators belonging to different antennas is at least the combined length of these radiators.

The antennas according to FIG. 3 can be designed e.g. as follows:

- the antenna based on the component 310 is an antenna for the GSM850 system;
- the antenna based on the component 320 is an antenna for the GSM900 system;
- the antenna based on the component 330 is an antenna for the GSM1800 system;
- the antenna based on the component 340 is a transmitting antenna for the WCDMA system;
- the antenna based on the component 350 is a receiving antenna for the WCDMA system;
- the antenna based on the component 360 is an antenna for the GSM1900 system.

Figure 4A:
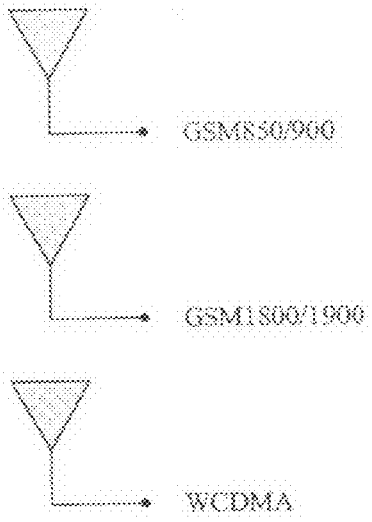
FIGS. 4*a-e* show examples of the composition of an antenna system according to the invention.
Figure 4B:
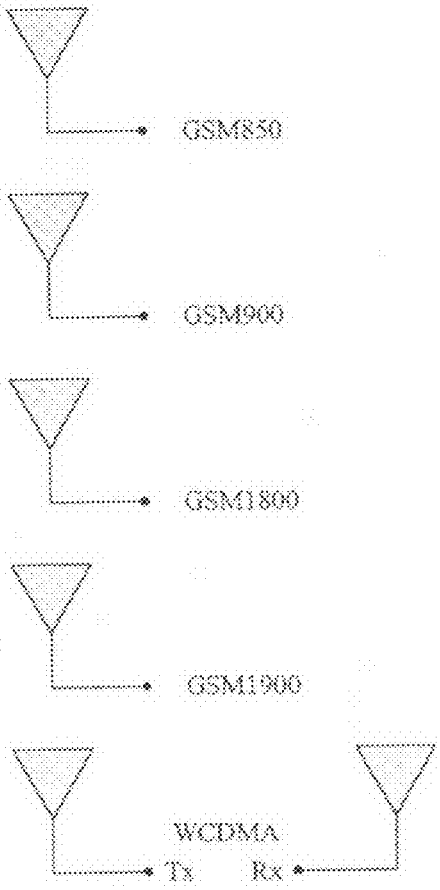
Figure 4C:
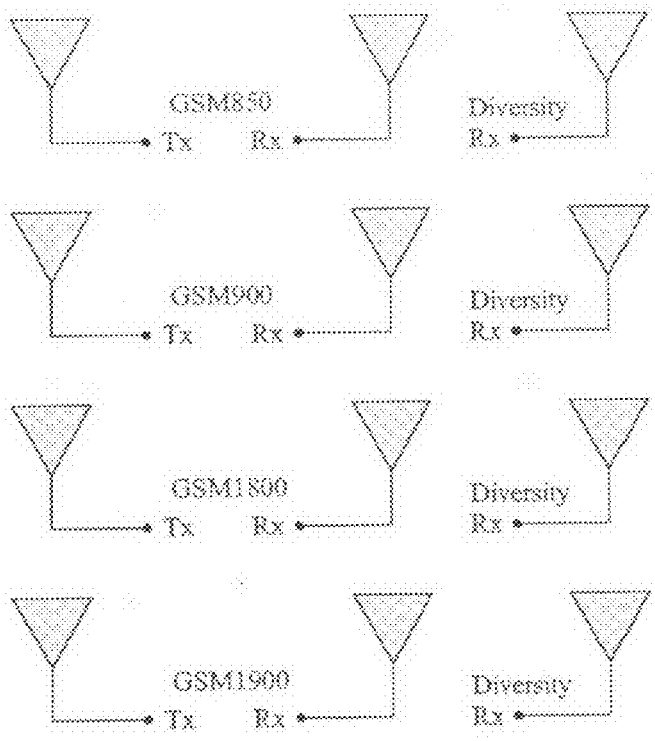
Figure 4D:
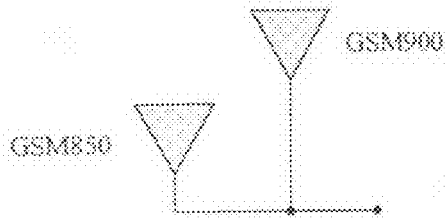

FIGS. 4*a*-4*e* show examples of the composition of the antenna system according to the invention as schematic diagrams. In FIG. 4*a* there are three antennas. One of them is shared between the GSM850 and GSM900 systems, the second is shared between the GSM1800 and GSM1900 systems, and the third is for the WCDMA system. In FIG. 4*b*, there are six antennas for the same bands as above in the example mentioned in the description of FIG. 3. So, one of them is for the GSM850 system, the second for the GSM900, the third for the GSM1800, the fourth for the GSM1900, the fifth for the transmitting side of the WCDMA system, and the sixth for the receiving side of the WCDMA system, listed in the order of FIG. 4*b*. In FIG. 4*c* there are twelve antennas. One of them is for the transmitting side of the GSM850 system, and the second and the third for the receiving side of the GSM850 system. The latter two are used to implement the space diversity in the receiving. There is a corresponding group of three antennas for the GSM900, GSM1800 and GSM1900 system as well. In FIG. 4*d* there is a separate antenna for both the GSM850 and GSM900 system, like in FIG. 4*b*. However, in this case the antennas are connected to the same feed line. After the separation of the transfer directions, the antennas then become connected to the shared transmitter and the shared receiver of these systems. In the same way also other antennas, the operating bands of which are close to each other, can be connected to a shared feed line.

Figure 4E:
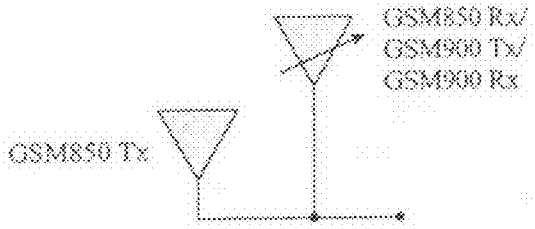

In FIG. 4*e* there are two antennas, existing for the GSM850 and GSM900 system, connected to the same feed line, like in FIG. 4*d*. In this case the operating band of one antenna covers only the transmitting band of the GSM850 system. The other antenna is adjustable so that its operating band can be set to cover either the receiving band of the GSM850 system, the transmitting band of the GSM900 system or the receiving band of the GSM900 system. These three bands are successive so that there are only relatively narrow unused frequency ranges between them. Compared with FIG. 4*d*, no saving regarding the number of the antennas is achieved by the arrangement of FIG. 4*e*, but it has the advantage that both antennas have a narrower band.

Figure 5:
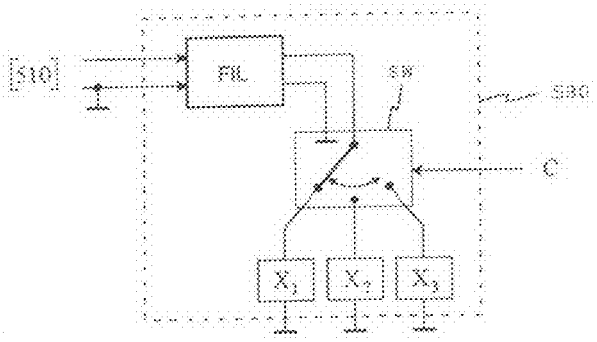
FIG. 5 shows an example of an adjusting circuit, by which the operating band of an antenna can be displaced.

FIG. 5 presents as block diagram an example of an adjusting circuit, by which the operating band of an antenna can be set to different places. The number of the places is three in this example. The adjusting circuit 580 is connected to an antenna component 510 and the ground plane. Seen from the antenna, the adjusting circuit includes first a filter FIL. Its object is here to attenuate the harmonic frequency components developing in the switch and to function as an ESD (Electrostatic Discharge) protector of the switch. The filter type is for example high-pass or bandpass one. The second port of the filter is connected to the input of the switch SW, which has three alternative outputs. Each output is coupled to the ground through a different reactive circuit, the reactances $X_1$, $X_2$ and $X_3$ of these circuits deviating from each other. Thus the radiator(s) in the antenna component can be coupled to the ground through three alternative reactances. In a simple case the reactive circuit is a short-circuit with short conductors (very high reactance). Changing the reactance by controlling the switch changes the resonance frequency/frequencies of the antenna and in that way the place of its operating band. The switch is controlled by the signal C.

Figure 6A:
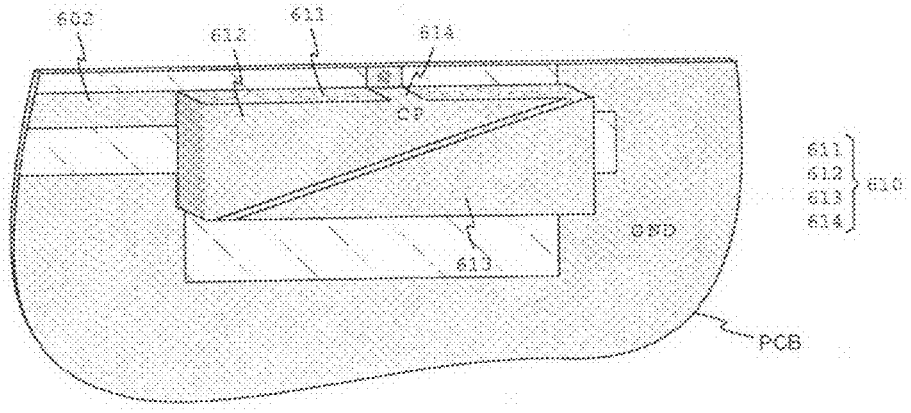
FIG. 6*a* shows an example of an individual antenna and its connection to the adjusting circuit.

FIG. 6*a* shows an example of an individual antenna and its connection to the adjusting circuit. A part of the circuit board PCB of a radio device, on which board there is mounted an antenna component 610, is seen in the figure. The antenna component comprises a substrate 611, a first radiating element 612 fed by the feed conductor 602 and a parasitic radiating element 613. The radiating elements are located symmetrically so that each of them covers a part of the upper surface of the substrate and one of the opposite end surfaces. A relatively narrow slot is left over between the elements, which slot extends diagonally from a corner to the opposite corner of the substrate's upper surface. Also in this example, as already mentioned in the description of FIG. 3, the ground plane of the surface of the circuit board has been removed from below and beside the antenna component 610 to a certain distance. Such an arrangement increases the electric size of the antenna compared to that the ground plane would continue as wide to the area under the component. In that case for example the height of an antenna component functioning in a certain frequency range can be correspondingly reduced. However, the ground plane extends both to the first radiator 612 and the parasitic radiator 613 at the ends of the antenna component.

For the antenna adjusting, the antenna component further comprises a strip conductor 614 extending along a side surface of the substrate from the first radiator 612 to the surface of the circuit board PCB. That strip conductor is then galvanically connected to the first radiator in a control point CP. The galvanic connection continues in this example through a via to the opposite side of the circuit board, where the adjusting circuit of the antenna in question is located.

Figure 6B:
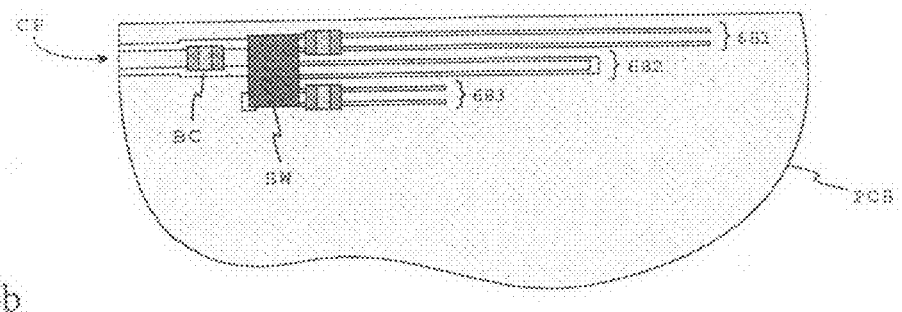
FIG. 6*b* shows an example of the adjusting circuit of the antenna in FIG. 6*a,*

FIG. 6*b* shows an example of the adjusting circuit of the antenna in FIG. 6*a*. A part of the circuit board PCB of FIG. 6*a* is seen from the reverse side in the drawing. The adjusting circuit comprises a switch and three transmission lines. The conductor coming from the control point CP is connected to the input port of the switch SW through a blocking capacitor BC, by which the direct current circuit from the switch control to the ground through the switch input is broken. The switch has three alternative outputs, each of them being coupled to a transmission line. The transmission lines are in this example planar lines on the surface of the circuit board PCB. Each line comprises a middle conductor and a ground conductor on its both sides. The first transmission line 681 is short-circuited at its tail end, the second transmission line 682 is open and the third transmission line 683 is short-circuited. At the head end of each short-circuited line there is a similar blocking capacitor as also on the input side of the switch. The lengths of the transmission lines are respectively 32 mm, 25 mm and 11 mm, for instance. The transmission lines have then the length less than a quarter wave at the frequencies of order of one GHz. This means that the first and third transmission lines represent capacitive reactances with different values, and the second transmission line represents an inductive reactance with a certain value. When the transmission line connected to the switch input is replaced by controlling the switch, the resonance frequency of the antenna and the place of its operating band are changed.

There is no filter between the switch and the antenna component in the example of FIG. 6*b*. If desired, such a filter is obtained for example by adding a coil between the ground and the conductor coming from the control point CP. In this case the coil together with the capacitor BC forms a high-pass filter for the ESD protection of the switch.

Figure 7:
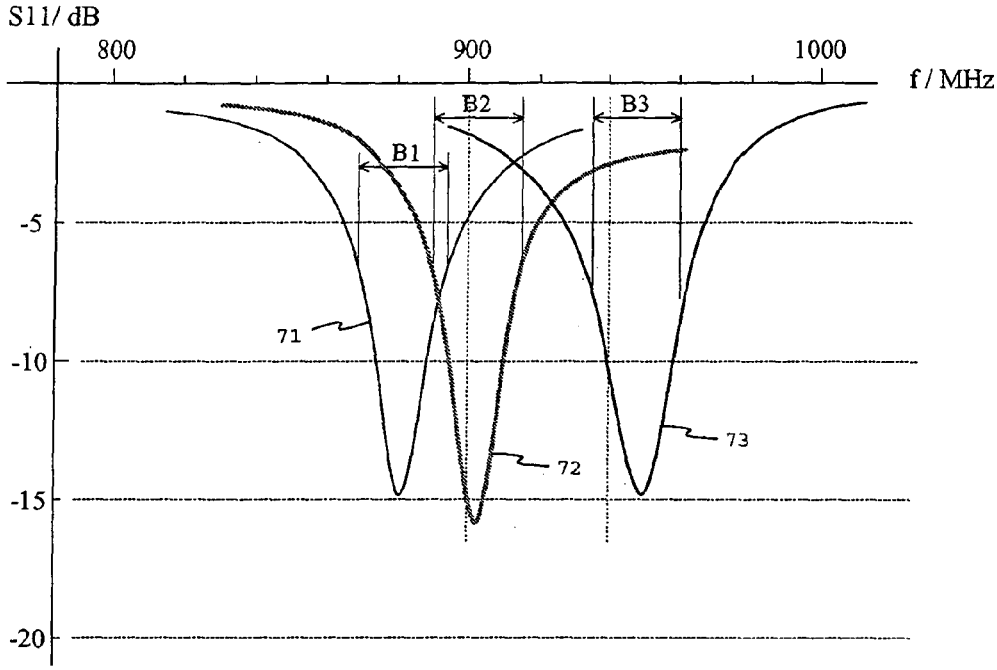
FIG. 7 shows an example of displacement of the operating band of an antenna suitable for the adjustable antenna in FIG. 4*e,*

FIG. 7 shows an example of displacement of the operating band of an antenna suitable for the adjustable antenna in FIG. 4*e*. So the antenna has three alternative operating bands, and they are implemented by a structure according to FIGS. 6*a* and 6*b*. Curve 71 shows the reflection coefficient S11 as a function of frequency, when the antenna is intended to function as the receiving antenna in the GSM850 system, the receiving band B1 of which is 869-894 MHz. It is seen from the curve that the reflection coefficient is −7 dB or better at this setting of the adjusting circuit. Thus the antenna's operating band covers well the required range. Curve 72 shows the reflection coefficient as a function of frequency, when the antenna is intended to function as the transmitting antenna in the GSM900 system, the transmitting band B2 of which is 890-915 MHz. It is seen from the curve that the reflection coefficient is −7 dB or better also at this setting of the adjusting circuit. Thus the antenna's operating band covers well the required range. Curve 73 shows the reflection coefficient as a function of frequency, when the antenna is intended to function as the receiving antenna in the GSM900 system, the receiving band B3 of which is 935-960 MHz. It is seen from the curve that the reflection coefficient is about −8 dB or better at this setting of the adjusting circuit. Thus the antenna's operating band covers well the required range.

Figure 8:
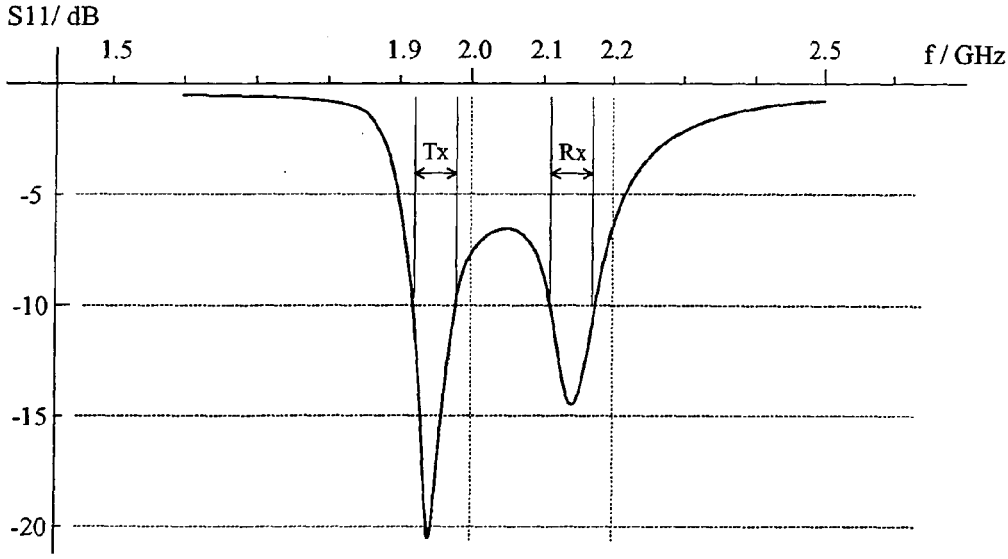
FIG. 8 shows an example of the matching of a pair of antennas in the antenna system according to FIG. 3.

FIG. 8 shows an example of the matching of the antenna system according to FIG. 3 for the antennas corresponding to the fourth 340 and the fifth 350 antenna component, when these are designed to function as the transmitting and receiving antennas of the WCDMA system. The substrate of the antenna components is of a ceramics, and its dimensions are 10·3·2 $mm^3$ (length, width, height). The matching appears from the curve of the reflection coefficient S11 as a function of frequency. It is seen from the curve that the reflection coefficient is −10 dB or better in the range of both the transmitting and the receiving band. The matching of the antenna pair is then good.

Figure 9:
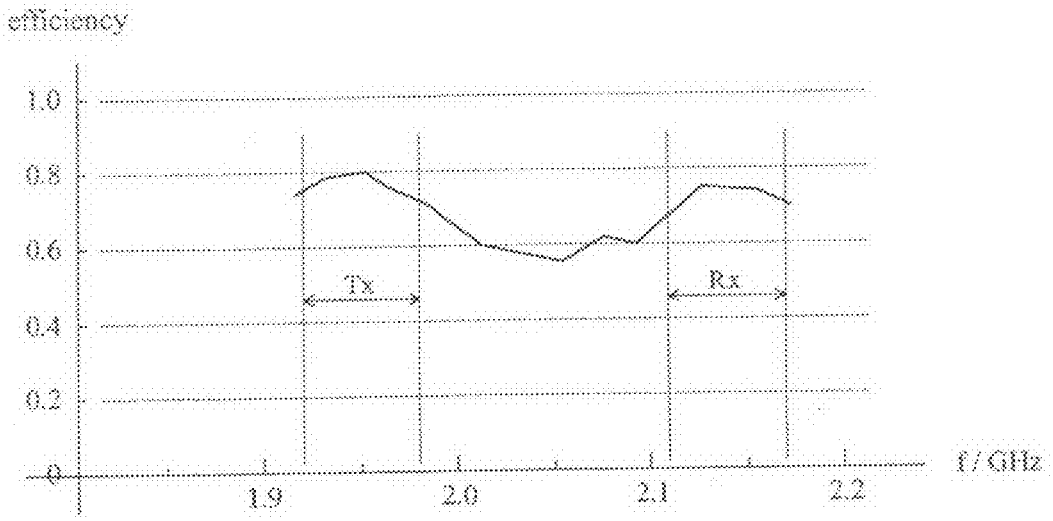
FIG. 9 shows an example of the efficiency of a pair of antennas in the antenna system according to FIG. 3.

FIG. 9 shows a curve of the efficiency of the same antenna pair to which FIG. 8 applies as a function of frequency. It is seen that the efficiency is approx. 0.76 on an average in the transmitting band and approx. 0.72 on the receiving band. The efficiency of the antenna pair is then excellent considering the small size of the antenna components. The maximum gain of the transmitting antenna is approx. 1.3 dB and the maximum gain of the receiving antenna approx. 2.3 dB on an average as measured in free space.

Figure 10:
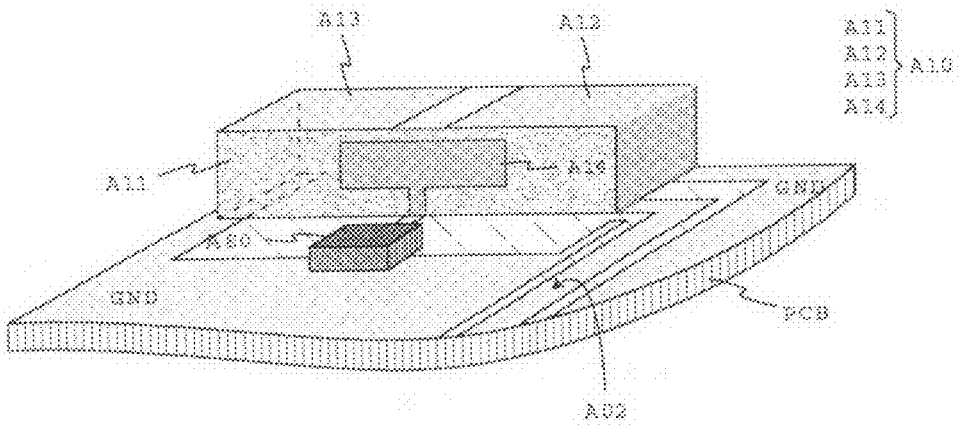
FIG. 10 shows another example of an arrangement, by which the operating band of an antenna can be displaced.

FIG. 10 shows another example of an arrangement, by which the operating band of an antenna can be displaced. A part of the circuit board PCB of a radio device, on which board there is mounted an antenna component A10, is seen in the figure. The antenna component comprises also in this example a substrate A11, a radiator A12 fed via the feed conductor A02 and a parasitic radiator A13. The radiators are located symmetrically so that each of them covers a part of the upper surface of the substrate and one of the opposite end surfaces. In addition, the antenna component comprises a second parasitic element A14, which is located on one side surface of the substrate so that it has an electromagnetic coupling of equal strength to both radiators. The second parasitic element is connected by a conductive strip to the adjusting circuit A80 on the circuit board PCB, which adjusting circuit is presented as an integrated component in the figure. So the coupling of the adjusting circuit to the radiators is electromagnetic in this example. The control of the adjusting circuit takes place e.g. through a via in the circuit board, the control being invisible in the figure.

A decentralized antenna system according to the invention has been described above. As appears from the examples described, the number and the location of the antennas can vary greatly. An individual antenna can include also only one radiating element. Some or all of the reactances of the adjusting circuit can be naturally implemented by discrete components, too. The adjusting circuit can also be based on the use of capacitance diodes, in which case the adjustment can be continuous instead of the step-wise one. The band of an adjustable antenna can also cover only a part of the transmitting or receiving band of a system using a large frequency range. The invention does not limit the method of manufacture of individual antenna components. The manufacture can take place for example by coating a piece of ceramics partly with conductive material or by growing a metal layer on the surface e.g. of silicon and removing a part of it by the technique used in the manufacture of semiconductor components. An individual substrate can also be a part of the outer casing of a radio device.

The invention claimed is:

1. An adjusting circuit for use with an antenna system of a radio device, said adjusting circuit comprising:

an input electrically coupled to an antenna component;

a filter circuit;

a switching circuit; and a plurality of reactive circuits each coupled to an end of said switching circuit.

2. The adjusting circuit of claim 1, wherein said plurality of reactive circuits each comprise a different operating band.

3. The adjusting circuit of claim 2, wherein the number of said plurality of reactive circuits is three.

4. The adjusting circuit of claim 1, wherein each of said plurality of reactive circuits is further coupled to ground.

5. The adjusting circuit of claim 1, wherein said filter circuit is adapted to attenuate at least a portion of harmonic frequency components that develop within said switching circuit.

6. The adjusting circuit of claim 5, wherein said filter circuit further comprises electrostatic discharge (ESD) protection.

7. The adjusting circuit of claim 1, wherein the positioning of said switching circuit is controlled by a control signal.

8. The adjusting circuit of claim 1, wherein at least one of said plurality of reactive circuits comprises an inductive reactance.

9. The adjusting circuit of claim 8, wherein at least one of said plurality of reactive circuits comprises a capacitive reactance.

10. The adjusting circuit of claim 1, wherein each of said plurality of reactive circuits comprises a transmission line coupled to ground.

11. The adjusting circuit of claim 10, wherein each of said transmission lines for said plurality of reactive circuits is of a differing length.

12. The adjusting circuit of claim 1, wherein each of said plurality of reactive circuits is adapted for a plurality of separate operating applications.

13. The adjusting circuit of claim 12, wherein said plurality of separate operating applications are selected from the group consisting of:

a GSM850 application;

a GSM900 application;

a GSM1800 application;

a GSM1900 application; and a WCDMA application.

14. An antenna system of a radio device, said system comprising:

a ground plane;

at least two antennas each comprising a radiating element, wherein each radiating element comprises a conductor on a surface of a dielectric substrate;

wherein a distance along said ground plane between two of said radiating elements belonging to different antennas is at least the combined length of these two radiating elements; and wherein at least one antenna is connected to an adjusting circuit.

15. The antenna system of claim 14, wherein said adjusting circuit comprises:

a switching circuit; and a plurality of reactive circuits each coupled to an end of said switching circuit.

16. The antenna system of claim 14, wherein at least one of the antennas is disposed on a surface of an internal frame of the radio device.

17. An antenna system of a radio device, which system comprises a ground plane and at least two antennas, each radiating element of which is a conductor on a surface of a dielectric substrate, characterized in that:

a distance along said ground plane between two of said radiating elements belonging to different ones of said antennas is at least the combined length of the radiating elements, and at least one of said antennas is connected to an adjusting circuit adapted to displace an operating band thereof.

18. An antenna system according to claim 17, characterized in that the substrate of an individual one of said at least two antennas and the at least one radiating element on the surface of the substrate constitute a unitary, chip-type antenna component.

19. An antenna system according to claim 18, characterized in that said antenna component is located on a circuit board of the radio device.

20. An antenna system according to claim 18, characterized in that said antenna component is disposed on a surface of an internal frame of the radio device.

21. An antenna system according to claim 17, characterized in that an operating band of at least one of said at least two antennas comprises a frequency range used by at least one radio system.

22. An antenna system according to claim 17, wherein an operating band of at least one of said at least two antennas comprises a transmitting band in the frequency range used by a radio system, and an operating band of another one of said at least two antennas comprises a receiving band of the same frequency range.

23. An antenna system according to claim 22, wherein at least one of said at least two antennas comprises an operating band of which includes the receiving band of the frequency range used to implement a spatial diversity function.

24. An antenna system according to claim 17, wherein said adjusting circuit comprises a switch and alternative reactive circuits adapted to change a resonance frequency of at least one of the antennas so as to displace an operating band of the at least one antenna.

25. An antenna system according to claim 24, characterized in that said reactive circuits comprise planar transmission lines.

26. An antenna system according to claim 17, characterized in that said adjusting circuit is connected galvanically to a radiating element of one of said antennas.

27. An antenna system according to claim 17, characterized in that said substrate comprises a ceramic material.

28. An antenna system according to claim 17, characterized in that the substrate of an individual one of said at least two antennas comprises a part of an outer casing of the radio device.

29. A method of operating an antenna system of a radio device, said antenna system comprising a ground plane, an antenna, and an adjusting circuit, said method comprising:

operating said antenna system in a first mode of operation;

sending a control signal to said adjusting circuit, said control signal switching an operating mode of said adjusting circuit;

operating said antenna system in a second mode of operation, said first and second modes of operation utilizing said antenna; and operating said antenna system in a third mode of operation, said third mode of operation also using said antenna.

30. The method of claim 29, wherein said first and second modes of operation comprise the GSM850 and GSM900 modes of operation, respectively.

31. The method of claim 29, wherein said first and second modes of operation comprise the GSM1800 and GSM1900 modes of operation, respectively.

32. The method of claim 29, wherein said first, second and third modes of operation comprise the GSM850 receiving band, GSM900 transmitting band and GSM900 receiving bands, respectively.

33. An adjusting circuit for use with an antenna system of a radio device, said adjusting circuit comprising:

an input electrically coupled to an antenna component;

filter means;

switching means; and a plurality of reactive circuits each coupled to an end of said switching means.

34. An antenna system of a radio device, which system comprises a ground plane and at least two antennas, each radiating means of which is a conductor on a surface of a dielectric substrate, characterized in that:

a distance along said ground plane between two of said radiating means belonging to different ones of said antennas is at least the combined length of the radiating means, and at least one of said antennas is connected to an adjusting means for displacing an operating band thereof.

* * * * *